United States Patent [19]

Fukuda et al.

[11] Patent Number: 4,813,222

[45] Date of Patent: Mar. 21, 1989

[54] SYSTEM FOR TRANSFERRING FULL AND EMPTY BOBBINS FROM AND TO A TEXTILE MACHINE SUCH AS A RING SPINNING FRAME

[75] Inventors: Tatemi Fukuda; Masayoshi Tsuboi; Meiji Anahara; Yoshiharu Yasui, all of Kariya, Japan

[73] Assignee: Kabushiki Kaisha Toyoda Jidoshokki Seisakusho, Aichi, Japan

[21] Appl. No.: 173,375

[22] Filed: Mar. 25, 1988

[30] Foreign Application Priority Data

Apr. 9, 1987 [DE] Fed. Rep. of Germany ..... 3712027
Apr. 30, 1987 [JP] Japan ..... 62-108108

[51] Int. Cl.[4] ..... D01H 9/04; D01H 9/18

[52] U.S. Cl. ..... 57/274; 57/266; 57/276; 57/281; 242/35.5 A

[58] Field of Search ..... 57/266, 276, 281, 268, 57/274; 242/35.5 A, 35.5 R

[56] References Cited

U.S. PATENT DOCUMENTS 3,905,184 9/1975 Takai et al. ..... 57/274
4,014,161 3/1977 Cox ..... 57/274
4,338,778 7/1982 Suzuki et al. ..... 57/276
4,586,668 5/1986 Mori ..... 242/35.5 A
4,676,061 6/1987 Yamamoto ..... 57/276

FOREIGN PATENT DOCUMENTS 57-161133 10/1982 Japan .

*Primary Examiner*—John Petrakes
*Attorney, Agent, or Firm*—Burgess, Ryan & Wayne

[57] ABSTRACT

A bobbin transfer system of a spinning frame (1), in which a series of trays (13) are carried on a pair of carrier rails (14, 15) driven to repeat a back-and-forth reciprocation. Hooking members (23) are arranged along the carrier rails (14, 15), which allow the trays (13) to pass thereover during the forward displacement of the carrier rail (14, 15) but inhibit the backward displacement of the trays (13) by the action of hooks (23*a*) formed on the hooking member (23) at a distance from each other corresponding to N times the spindle pitch wherein N satisfies the equation $\Delta A \geqq \Delta D \times N$ (wherein $\Delta D$ stands for a manufacturing tolerance of a diameter of the tray 13 and $\Delta A$ stands for an allowance for a grip distance of a bobbin catcher in an auto-doffer) and p stands for a spindle pitch. Accordingly, the trays (13) are transferred intermittently as the carrier rails (14, 15) reciprocate at a stroke larger than the spindle pitch.

3 Claims, 13 Drawing Sheets

SYSTEM FOR TRANSFERRING FULL AND EMPTY BOBBINS FROM AND TO A TEXTILE MACHINE SUCH AS A RING SPINNING FRAME

BACKGROUND OF THE INVENTION

1. Field of the Invention

The present invention relates to a system for transferring bobbins from and to a textile machine provided with a plurality of spindles, such as a ring spinning frame or a ring twisting frame.

2. Description of the Related Arts

In a ring spinning frame, a bobbin exchanging operation is necessary at the stage of doffing cops formed on spindles, in which first, a plurality of empty bobbins are arranged along a row of spindles so that each empty bobbin is positioned in front of the respective spindle, and then full bobbins (cops) on the spindles are exchanged with the empty bobbins by an auto-doffer. Removal of the doffed full bobbin from the spinning frame and preparation of the fresh empty bobbin thereto are generally carried out by a common conveyor comprising a steel belt extending on each side of the spinning frame and driven by a pair of pulleys provided on both ends of the belt. The steel belt carries a plurality of pegs for mounting the bobbins thereon, which pegs are secured at an accurate pitch corresponding to a spindle pitch or a half thereof so that an exact correspondence between the peg and the spindle is obtained when the doffing operation is carried out. The steel belt, however, has a serious drawback of elongation during use, which causes the peg pitch to increase. Under such circumstances, the pegs deviate from the desired positions due to an accumulation of pitch errors, and thus the doffing operation is hindered thereby.

To solve the above problem, a bobbin transferring apparatus without a steel belt was proposed, for example, in Japanese Unexamined Patent Publication (Kokai) No. 57-161133. According to this apparatus, as illustrated in FIGS. 16 and 17, a plurality of disc-like trays 73 are slidably placed, in series, on a guide rail 72 extending along a row of spindles 74. Each tray has a peg **73*a* thereon for mounting a bobbin and a circular recess 73*b* on the underside thereof. The recess 73*b* is engageable with each of checking elements 75 mounted on a rod 76 at a predetermined distance from each other. The checking element 75 is reciprocally movable together with the rod 76 along the guide rail 72 by the action of a cylinder 77, so that the tray 73 moves forward during the forward displacement of the checking element due to the engagement of the checking element 75 with the recess 73*b* of the tray 73 but remains in the forward position during the backward displacement of the checking element 75 due to the disengagement of the checking element 75 from the recess 73*b*. Repetition of the above movement causes the tray 73 to advance sequentially along the guide rail 72**.

According to the above apparatus, the tray 73 has a diameter identical to the spindle pitch so that the peg pitch corresponds to the spindle pitch when the pegs are positioned in front of the spindle row in a such a manner that the respective tray is brought into contact with the adjacent one. The present available spinning frame generally has about 200 spindles or more in the respective side thereof. If the manufacturing tolerance of each tray is 0.1 mm, the total error for 200 trays may amount to 20 mm over the row, and this will hinder the smooth doffing operation. To eliminate the inconvenience caused by the accumulation of manufacturing errors of the tray, the above apparatus is provided with a plurality of checking elements 75 at a predetermined distance, as stated before, so that a relatively less number of trays are displaced, as one group, by the respective checking element. According to this group displacement, the effective total error for all the trays is divided into the respective groups and can be minimized. In this connection, the following formula must be satisfied for the smooth doffing operation:

$$\Delta \geqq \Delta D \times N$$

wherein $\Delta A$ stands for an allowance for a grip distance of a bobbin catcher in an auto-doffer; $\Delta D$ stands for a manufacturing tolerance of the tray; and N stands for the number of trays in one group.

$\Delta A$ is 2 mm in the maximum value for securely gripping the bobbin. While, $\Delta D$ is usually 0.3 mm when a plastic tray is used without machining to reduce the manufacturing cost. Therefore, in this case, the number N of trays in one group must be smaller than 6. This means that at least 200/6, i.e., thirty four checking elements 75 are necessary for displacing the trays on one side of the spinning frame. As shown in FIG. 17, the checking element 75 is swingably pivoted on a pin 78 so that it can selectively occupy an operative position at which the tip end of the element 75 is engageable with the recess **73*b* of the tray 73 and a rest position at which the same allows the tray 73 to pass backward. In other words, the same number of moving mechanisms as that of the checking elements 75** is provided. It is not desirable to provide such a large number of moving mechanisms in the vicinity of a spinning frame in which many flies are floating in the atmosphere, because the flies are liable to enter between the parts of the moving mechanism and render them inoperative unless cleaning and maintenance of the moving mechanism is properly carried out.

SUMMARY OF THE INVENTION

It is an object of the present invention to solve the above drawbacks of the prior art bobbin transfer system utilizing trays.

It is another object of the present invention to provide an improved bobbin transfer system having less moving mechanisms compared to the number of checking elements.

The object is achievable by a system for transferring a plurality of full bobbins doffed from a textile machine such as a spinning frame to a downstream process and a plurality of empty bobbins donned on the textile machine from a source thereof, said textile machine having a row of spindles on each side thereof, on which said empty bobbins are mounted to form said full bobbins during a spinning operation, and having a longitudinal carrier carrying a series of movable trays thereon and disposed in front of said row of spindles, said tray having a peg on the top thereof on which said full or empty bobbin is held and an engaging recess underside thereof, and said trays being carried on said carrier so that a distance corresponding to a spindle pitch or half a spindle pitch is maintained between every adjacent two pegs, said full and empty bobbins mounted on said trays being transferred forward together with said trays by repeated back-and-forth reciprocation of a predetermined stroke of said carrier in such a manner that said trays are moved forward by forward displacement of said carrier and maintained in their forward positions by a checking mechanism during the backward displacement of said carrier, characterized in that said checking mechanism comprises at least one stationary hooking bar extending beneath and along said carrier and provided with a plurality of hooks shaped thereon and distributed at a predetermined distance corresponding to $N \times p$ from each other, wherein N stands for a natural number the equation $\Delta A \geqq \Delta D \times N$ (wherein$\Delta D$ stands for a manufacturing tolerance of a diameter of the tray 13 and $\Delta A$ stands for an allowance for a grip distance of a bobbin catcher in an auto-doffer) and p stands for spindle pitch, each of said hooking bars being resiliently urged upward by a spring means so that said hook is engageable with said engaging recess of said tray to interrupt the backward displacement of said tray during the backward displacement of said carrier and to allow said tray to advance together with said carrier during the forward displacement of the carrier.

According to this system, the carrier is driven to reciprocate in the longitudinal direction at a stroke larger than the spindle pitch. The trays are displaced together with the carrier during the forward displacement of the latter. While the trays are subjected to the forward displacement, the hooking bar is retracted to the rest position. After the forward displacement of the carrier has stopped, the hook is immediately engaged with the recess of the tray positioned above the hook by the biasing force of the spring. When the backward displacement of the carrier begins, the backward displacement of the trays preceding the engaged one is checked by the hook and only the carrier returns the initial position. Thus the trays are maintained in the forwarded position corresponding to the spindle.

Since the hooking bar is spring-loaded to be movable up-and-down without a pivot and a plurality of hooks are shaped thereon without moving parts, there is little influence by flies compared to the conventional bobbin transferring system.

BRIEF DESCRIPTION OF THE DRAWINGS

The other objects and further advantages of the present invention will be more apparent from the following description with reference to the drawings illustrating the preferred embodiments of the present invention, wherein:

FIG. 1 is a sectional view illustrating a supporting manner of a hooking bar;

FIG. 2 is a partial front view of a spinning frame and a bobbin transfer system according to the present invention;

FIG. 3 is a layout illustrating the relationship between a spinning frame and a winder;

FIG. 4 is a partial broken plan view of a bobbin transfer system;

FIG. 5 is a side sectional view of the bobbin transfer system shown in FIG. 4;

FIG. 6 is a partial perspective view of the bobbin transfer system shown in FIGS. 4 and 5;

FIGS. 7(*a*) and (*b*) is a plan view illustrating the operation of a deflection device;

FIG. 8 is a partial front view thereof;

FIG. 9 is a partial plan view thereof;

FIG. 10 is a section taken along line A—A of FIG. 9;

FIGS. 11(*a*) through (*f*) illustrate the operation of the second embodiment;

FIG. 12 is a partial plan view thereof;

FIG. 13 is a section taken along line B—B of FIG. 12;

DESCRIPTION OF THE PREFERRED EMBODIMENTS

With reference to FIGS. 1 through 7, a first embodiment of the present invention will be described below.

Figure 3:
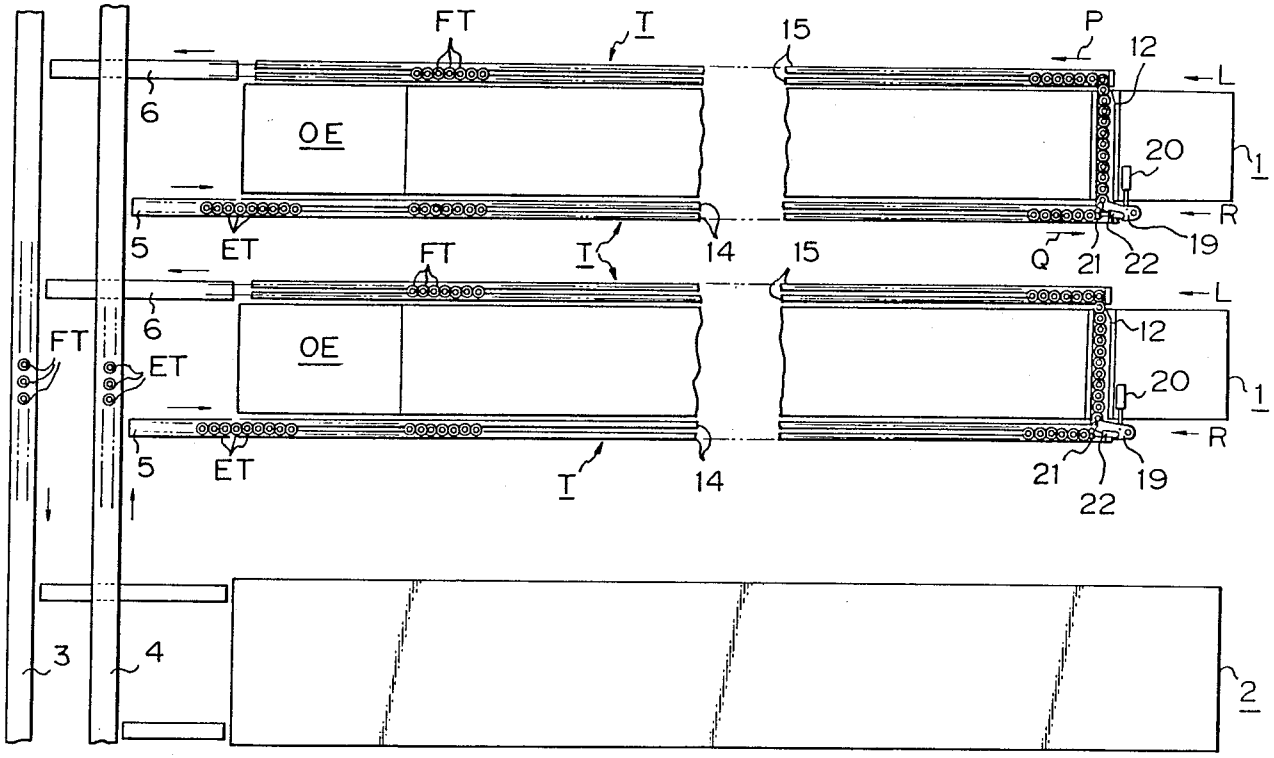

In FIG. 3, a bobbin transfer system, as a whole, is diagrammatically illustrated, in which a conveyor 3 for transporting trays FT, each mounting a full bobbin F doffed from a ring spinning frame 1 and a conveyor 4 for transporting trays ET, each mounting an empty bobbin E exhausted in a winder 2 extend in parallel to each other while transversely crossing one end OE of the spinning frame 1 and the winder 2. The tray ET is fed to the spinning frame 1 from the conveyor 4 through a sub-conveyor conveyor 5 arranged on the end of the spinning frame 1, while the tray FT is fed to the conveyor 3 from the spinning frame 1 through another sub-conveyor 6.

Figure 2:
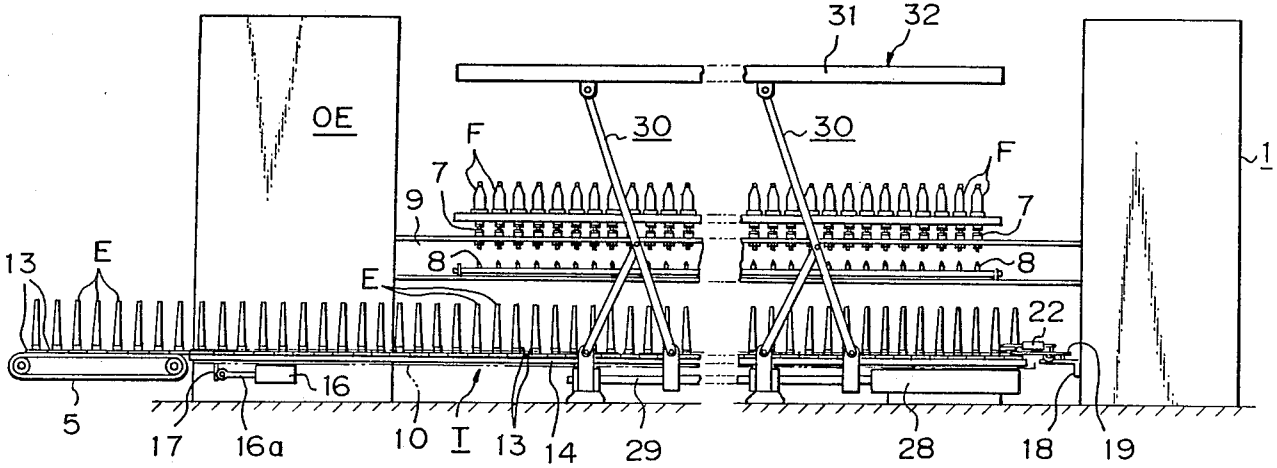
Figure 4:
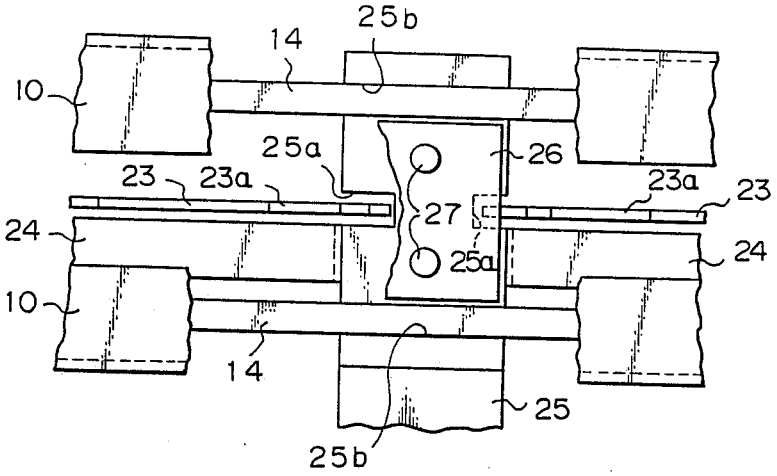
Figure 5:
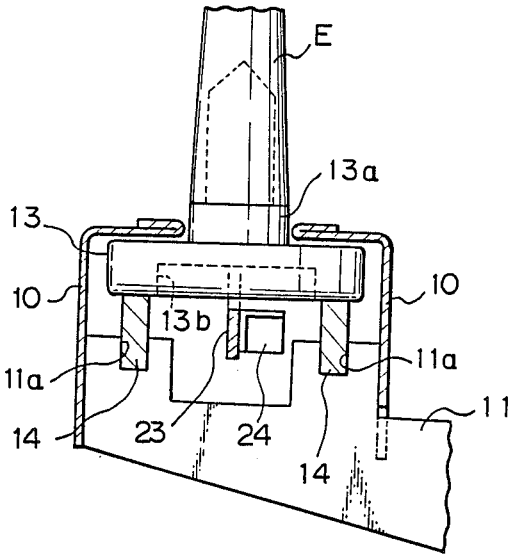
Figure 6:
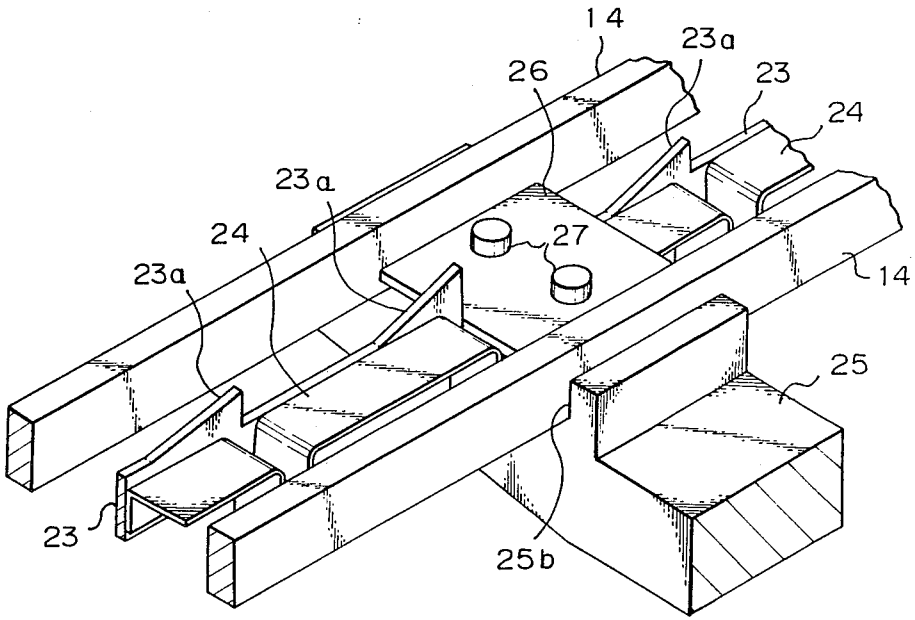

As shown in FIG. 2, a row of spindles 7 and a row of intermediate pegs 8 are secured at a predetermined pitch (spindle pitch) on the upper and lower portions, respectively, of a spindle rail 9 in parallel to each other. A pair of guide covers 10 extend along the row of spindles 7 and are supported by a plurality of brackets 11 (see FIG. 5) fixedly secured on a machine frame at a predetermined pitch. The guide covers reach the sub-conveyor 5 or 6 at one end and are connected with each other at the other end by a deflection rail 12 to form a continuous path beginning from the sub-conveyor conveyor 5 and ending at the sub-conveyor 6. As shown in FIGS. 3–5, a pair of carrier rails 14, 15 are mounted inside of and along the guide covers 10. The carrier rails 14 and 15 carry thereon a plurality of disc-like trays 13 with a peg 13*a* for mounting a bobbin, and are connected to a piston rod 16*a* of an air cylinder 16 disposed at the end of the spinning frame 1 to be movable in a reciprocated manner by the action of the air cylinder 16 along the row of spindles at a predetermined stroke larger than a spindle pitch.

In the vicinity of the connection between the carrier rail 14 extending in the R side of the spinning frame 1 (see FIG. 3) and the deflection rail 12, a bracket 18 is fixed, on which a pushing lever 19 is pivoted so that it can transversely swing over both of the end portions of guide cover 10 and deflection rail 12. The pushing lever 19 is operated by an air cylinder 20 also mounted on the bracket 18 so that it is brought into contact with the peg 13*a* of the tray 13 positioned at the outermost end of the carrier rail 14 and pushes the same onto the deflection rail 12 one by one. A stop lever 21 is pivoted at the tip of the pushing lever 19 to be possible to transversely swing over the guide cover 10 by the action of another air cylinder 22 secure on the pushing lever 19. The stop lever 21 temporarily stops the movement of the trays on the carrier rail 14 when the topmost tray is being transferred to the deflection rail 12.

Figure 1:
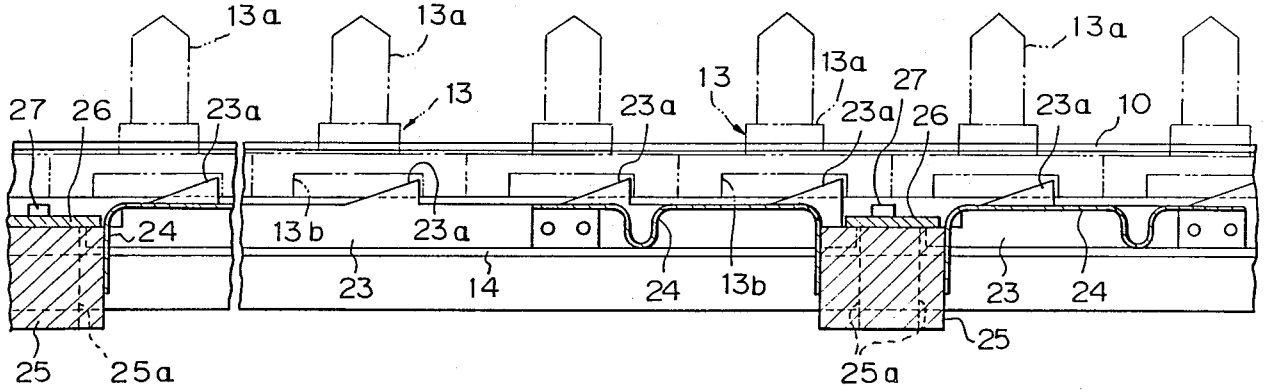
FIGS. 1 through 7 illustrate a first embodiment of the present invention.

As shown in FIGS. 1 and 4, inside the carrier rails 14 and 15, a hooking member 23 extends in the longitudinal direction of the carrier rails 14 and 15, which has a plurality of hooks 23*a* arranged in a saw tooth manner at a pitch corresponding to the spindle pitch and engageable with the recess 13*b* of the tray 13. The hooking member 23 is resiliently urged upward by a leaf spring 24 so that the hook 23*a* enters the recess 13*b* when the latter occupies a position opposite to the spindle 7. The spring 24 is fixed, at one end, to a bracket 25 having also a function for guiding the carrier rails 14, 15 and, at the other end, to the side of the hooking member 23. The bracket 25 has, in the front and rear walls thereof, a pair of vertical slots 25*a* for allowing the up-down motion of the hooking member 23 and, on the top thereof, a lid 26 fixed by screws 27 for closing the opening of the slot 25*a* and limiting the up-down motion of the hooking member 23. According to the above structure, the hooking member 23 is supported by a pair of springs 24 in the vicinity of the front and rear end areas, while the respective ends are loosely inserted into the slots 25*a* formed in the adjacent brackets 25, and limit the upward displacement by the lid 26. The hooking member 23 is disposed in a stationary position so that all of the hooks 23*a* can be engageable with the recesses 13*b* when the trays 13 occupy the positions corresponding to the respective spindles.

The spinning frame 1 is equipped with a known simultaneous auto-doffer 32 having a bobbin nipping mechanism 31 movable in an up-down reciprocation through a link 30 by the action of a driving rod 29 connected to an oil cylinder 28.

The operation of the above system will be described below.

When the spinning frame 1 has stopped for the doffing of full bobbins, the empty bobbins E on the trays 13 are exchanged with the full bobbins F on the spindles 7 via the intermediate pegs 8 by the auto-doffer 32 in a known manner. Thereafter, removal of the full bobbins just doffed and introduction of fresh empty bobbins in front of the row of spindles are started.

The carrier rail 15 extending on the side L to connect with the sub-conveyor 6 is subjected to a back-and-forth reciprocation by the air cylinder 16 at a stroke larger than a spindle pitch. During the forward displacement of the carrier rail 15, the tray 13 carried thereon moves forward together with the carrier rail 15. In this connection, midway of the forward displacement, the tray 13 is temporarily caught by the hook 23*a* of the hooking member 23 but overides the same while suppressing the hooking member 23 due to weight thereof against the biasing force of the spring 24 during the remaining forward displacement. Thus, when the forward displacement (in the direction shown by arrow P in FIG. 3) of the carrier rail 15 is completed, the trays 13 are arranged so that the hook 23*a* enters the recess 13*b* while a space is formed between the front inner wall of the recess 13*b* and the tip of the hook 23*a*.

Next, the carrier rail 15 moves backward together with the trays 13 carried thereon. However, this backward displacement of the tray 13 is immediately checked by the hook 23*a* so that the trays 13 occupy the position corresponding to the respective spindles 7. In this connection, although the hooking member 23 also tends to move backward due to the elongation of the spring 24 caused by the dragging force of the backward motion of the trays 13, this unfavorable motion of the hooking member 23 is rapidly inhibited by a contact of the rear end of the hooking member 23 with the bracket 25.

Figure 7A:
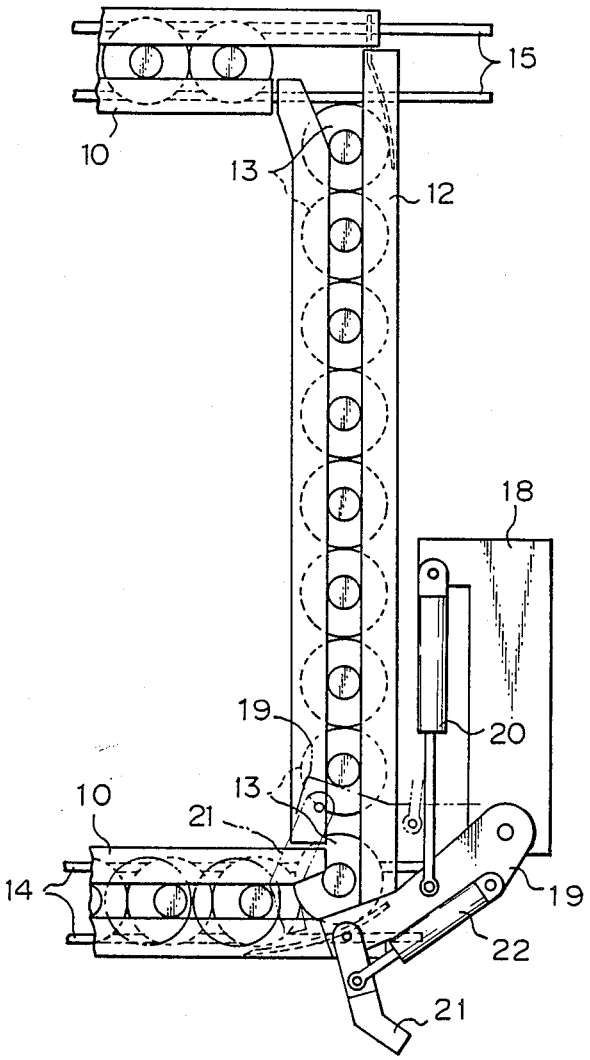
Figure 7B:
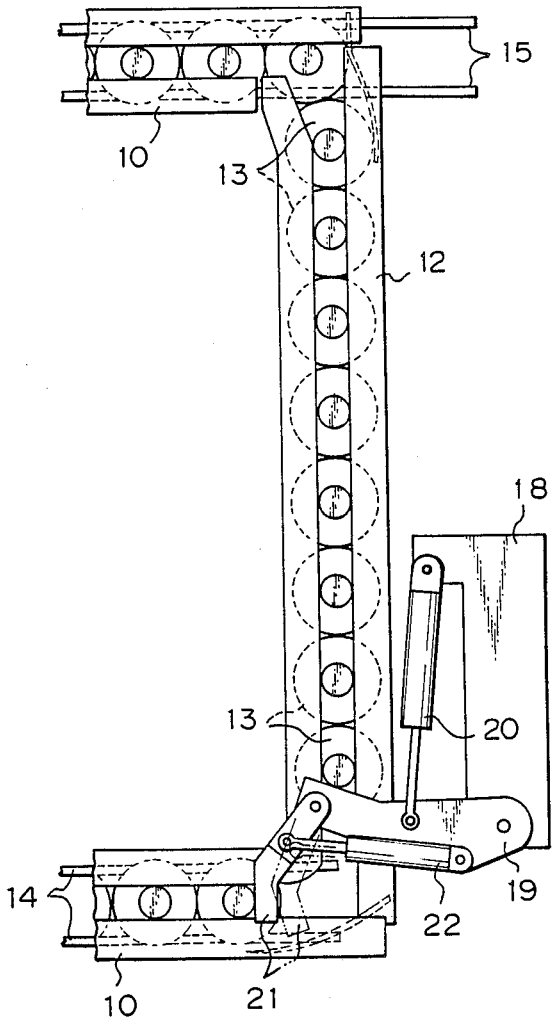

According to the forward displacement of the carrier rail 15, a vacant space corresponding to one tray is created in the border area between the deflection rail 12 and the carrier rail 15. Then the cylinder 20 operates to project a piston rod thereof when the carrier rail 15 has returned to the original position so that the pushing lever 19 rotates to move from a position shown by a chain line to that shown by a solid line n FIG. 7(*a*) for creating a vacant space in the border area between the carrier rail 14 and the deflection rail 12, in which space the topmost tray on the carrier rail 14 can enter. Thereafter, the air cylinder 16 provided on L side of the spinning frame 1 operates to retract a piston thereof, and simultaneously therewith, the other air cylinder 16 provided on the R side of the spinning frame 1 also operates to retract a piston rod thereof, whereby the carrier rail 14 is displaced in the forward direction as shown by an arrow Q in FIG. 3. Thus, the topmost tray 13 on the carrier rail 14 enters the border area between the carrier rail 14 and the deflection rail 12, as shown in FIG. 7(*a*). Then, the air cylinder 20 operates to retract a piston rod thereof, whereby the pushing lever 19 rotates clockwise so that the topmost tray 13 on the carrier rail 14 is transferred to the deflection rail 12. Simultaneously therewith, the topmost tray 13 on the deflection rail 12 is transferred to the other carrier rail 15 and occupies the tail end position. Next, the air cylinder 16 provided on the R side of the spinning frame 1 operates to extend a piston rod thereof so that the carrier rail 14 returns to the initial position shown in FIG. 3. During the backward displacement of the carrier rail 14, the hook 23*a* of the hooking member 23 is engaged with the recess 13*b* of the tray 13 so that the tray 13 cannot move backward together with the carrier rail 14 and can occupy the position corresponding to the respective spindle 7. Since the hooks 23*a* and the trays 13*a* correspond one to the other, the accumulation of manufacturing errors of the respective trays 13 as in the prior art apparatus can be eliminated. In other words, the positioning accuracy of the respective tray can be maintained within the manufacturing tolerance of one tray. According to the repetition of the above reciprocation of the carrier rails 14, 15 and the pushing lever 19, the tray 13 on the carrier rails 14, 15 and on the deflection rail 12 is displaced forward one by one at a distance corresponding to the spindle pitch. Thereby the tray with a full bobbin FT mounted on the carrier rail 15 is expelled to the sub-conveyor 6 and the tray with an empty bobbin ET mounted on the sub-conveyor 5 is fed to the carrier rail 14 so that the tray with the full bobbin FT can be replaced by the tray with the empty bobbin ET. As apparent from the above structure, the number of moving parts in this checking mechanism is far less than in the conventional one, because the hook 23*a* itself is stationary relative to the hooking member 23 and a plurality of the latter are carried on one hooking member 23 which is resiliently held by the spring 24 at the opposite ends thereof.

According to this checking mechanism, no pivots or slides exist for subjecting the hooking member 23 to the up-down reciprocation. Therefore, the mechanism is not adversely influenced even though flies are accumulated thereon, and the maintenance period can be extended. In the conventional system, the checking member is liable to vibrate when the reciprocation speed of carrier rails is increased above the ordinary speed of 10 through 30 reciprocations per minute. But, according to the system of the present invention, the vibration can be suppressed because the lid 26 brakes the upward displacement of the hooking member 23.

A second embodiment will be described below with reference to FIGS. 8 through 11.

Figure 8:
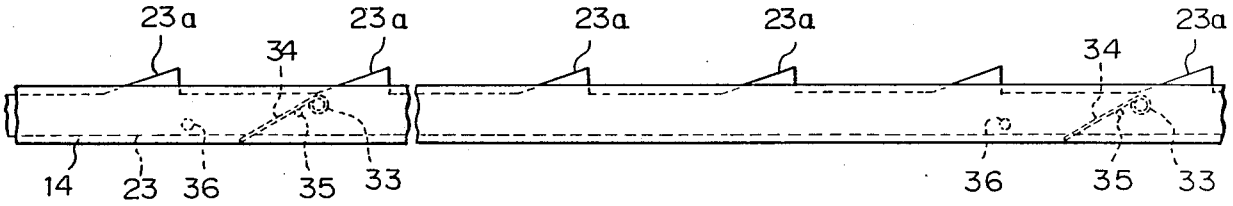
FIGS. 8 through 11 illustrate a second embodiment of the present invention.
Figure 9:
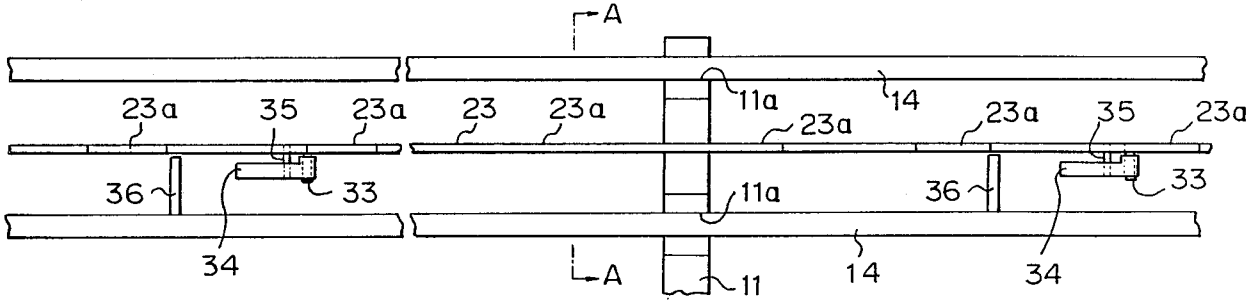
Figure 10:
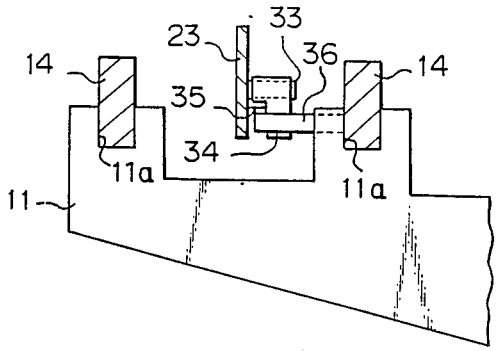

According to this embodiment, the hooking member 23 is not depressed directly by the tray 13 when the latter moves forward, as in the first embodiment. The hooking member 23 has two laterally projected pins 33 on one side thereof, on each of which a cam 34 is rotatably mounted. A stop 35 is projected from the side of the hooking member 23 to inhibit excessive pivoting of the cam 34, which is biased by a torsion spring (not shown) in the direction in FIG. 8. According to this structure, the cam 34 is held on the hooking member 23 so as to extend rearward in a downwardly slanted manner, as shown in FIGS. 8 and 11.

Another pin 36 engageable with the cam 34 is projected on the inside of the carrier rail 14 or 15 at a point lower than the stop 35 and farther from the pin 33 at a distance within a spindle pitch.

Accordingly, as shown in FIGS. 11(*a*) and 11(*b*), the pin 36 is brought into contact with the upper surface of the cam 34 during the passage of the forward displacement of the carrier rail 14 or 15, whereby the hooking member 23 is depressed as shown in FIG. 11(*b*). When the pin 36 is disengaged from the cam 34 due to further displacement of the carrier rail 14 or 15, the hooking member 23 is lifted up to the original position by a biasing force of the spring 24. While the hooking member 23 is subjected to the above up-down motion, the trays 13 mounted on the carrier rail 14 or 15 are displaced in the forward direction at a distance longer than the spindle pitch so that the hook 23*a* of the hooking member 23 enters the recess 13*b* of the tray 23. During the backward displacement of the carrier rail 14 or 15, the pin 36 is brought into contact with the lower surface of the cam 34. Further backward displacement of the pin 36 causes the cam 34 to rotate clockwise and return to the original position.

In this embodiment, since there is no frictional contact between the tray 13 and the back of the hook 23*a*, wear of the tray bottom is eliminated. Such wear causes the tray 13 to tilt on the carrier rail 14 or 15, which also causes the bobbin mounted thereon to tilt and interrupts the doffing operation. Moreover, by this elimination of frictional contact, the position of the tray 13 on the carrier rail 14 or 15 is not shifted during the forward displacement of the carrier rail even when the tray has a diameter smaller than the spindle pitch. This ensures an accurate positioning of the tray corresponding to the spindle.

Figure 12:
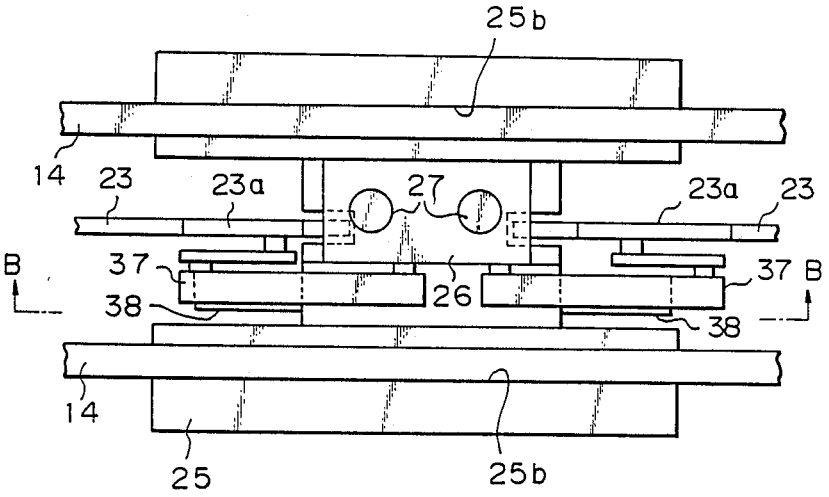
FIGS. 12 and 13 illustrate a third embodiment of the present invention.
Figure 13:
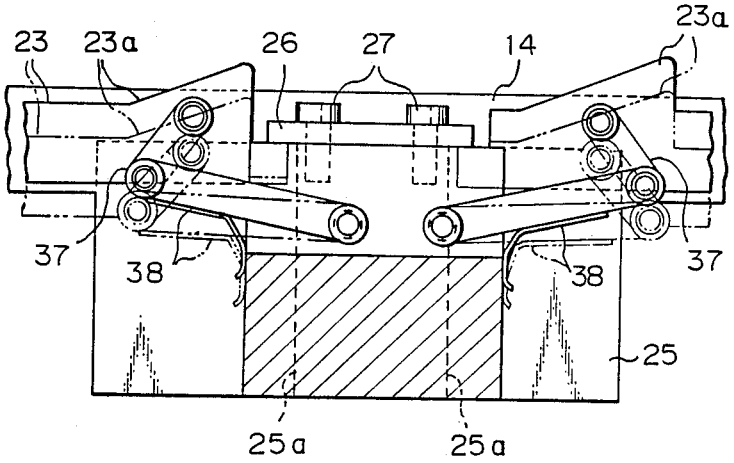
Figure 16:
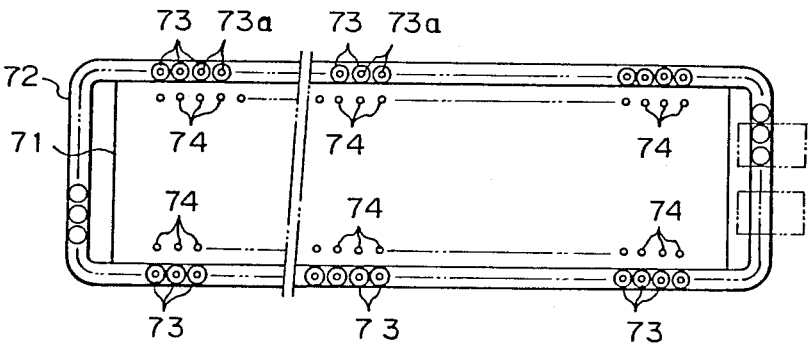
Fig. 16 PRIOR ART
FIG. 16 is a schematic plan view of the conventional system.
Figure 17:
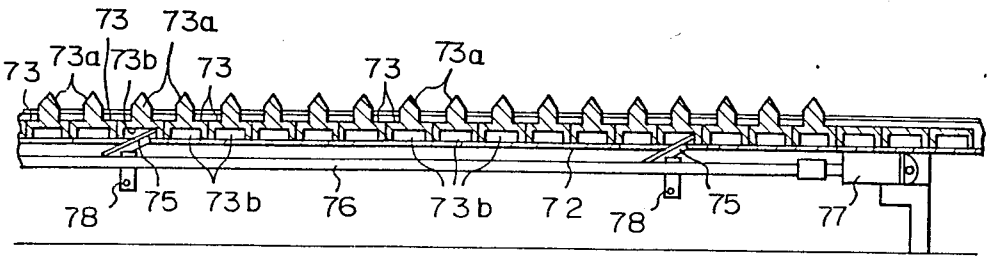
Fig. 17 PRIOR ART
FIG. 17 is a section of a main part of the conventional system shown in FIG. 16.

A third embodiment according to the present invention will be described with reference to FIGS. 12 and 13.

This embodiment has a supporting structure for the hooking member 23 different from those of the preceding two embodiments. The respective hooking member 23 is supported by a link 37 provided at the opposite ends thereof so as to be movable up-and-downwards. The hook 23*a* can enter the recess 13*b* of the tray 13 and is held at this position by a leaf spring 38, one end of which is fixed to the underside of the link 37 and the other end is brought into contact with the end surface of the bracket 25. According to this structure, when the hook 23*a* is pushed forward by the tray 13, the hooking member 23 is firmly depressed perpendicular to the carrier rail 14 or 15.

Figure 14:
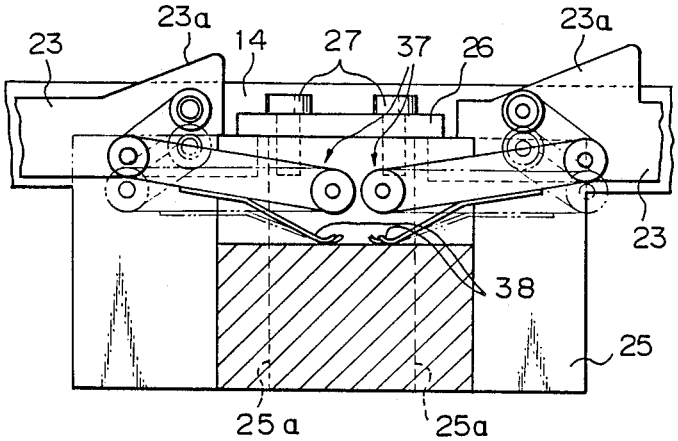
FIG. 14 is a sectional view of an alternative.
Figure 15:
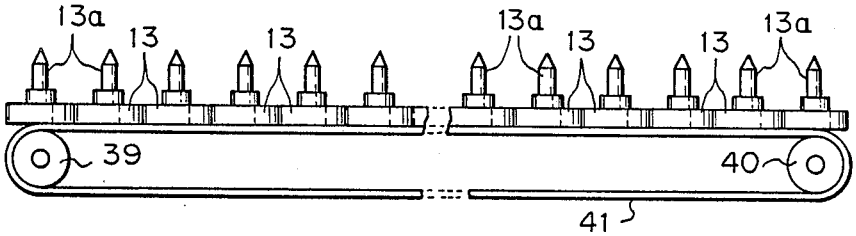
FIG. 15 is a partial front view of another alternative.
Figure 11A:
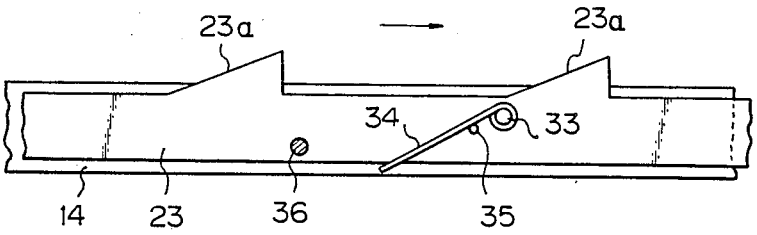
Figure 11B:
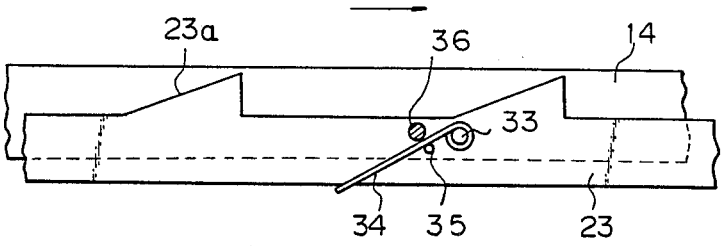
Figure 11C:
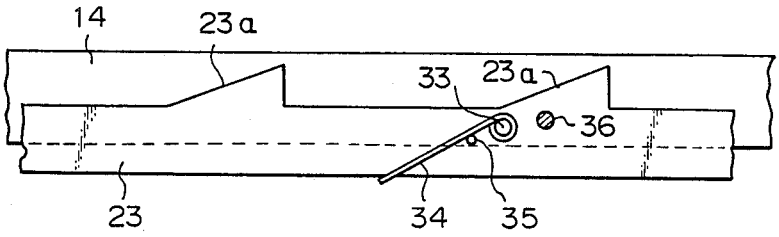
Figure 11D:
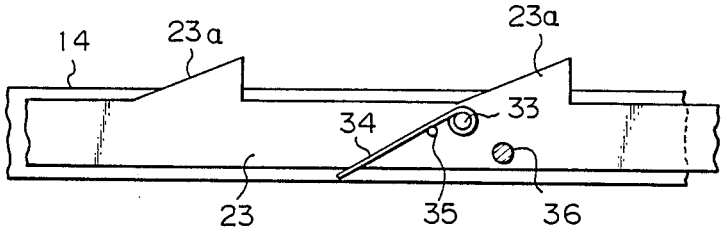
Figure 11E:
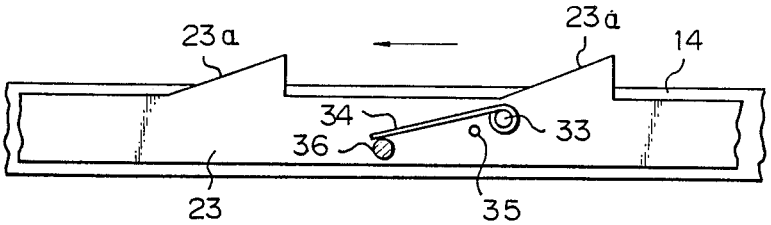
Figure 11F:
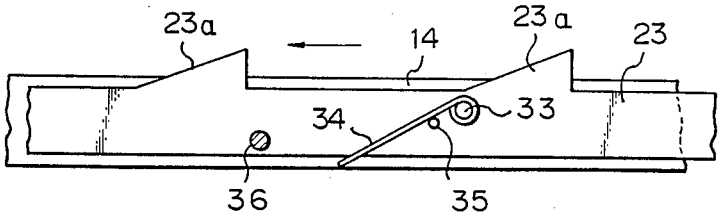

It should be noted that the present invention is not limited to the above embodiments but includes many modifications thereof. For example, the contact position of the leaf spring 38 with the bracket 25 may be changed as shown in FIG. 14. The carrier rail 14 or 15 may be replaced by a pair of endless belts 41 wrapped around a pair of reversibly rotatable pulleys 39, 40, as shown in FIG. 15. In the above embodiments, while the hooking member 23 has hooks 23*a* formed at a distance corresponding to the spindle pitch, the latter may be provided at a longer distance from each other, as long as the distance is N times the spindle pitch, wherein N is a natural number satisfying the following equation:

$$\Delta A \geqq \Delta D \times N$$

in which $\Delta D$ stands for a manufacturing tolerance of a diameter of the tray 13 and $\Delta A$ stands for an allowance for a grip distance of a bobbin catcher in the auto-doffer.

Also, the deflection rail 12 may be formed in an arcuate shape so that the pushing lever 19 actuated by the cylinder 20 can be omitted.

We claim:

1. A system including an auto-doffer having a bobbin catcher for transferring a plurality of full bobbins doffed from a textile machine such as a spinning frame to a downstream process and a plurality of empty bobbins donned on the textile machine from a source thereof, said textile machine having a row of spindles on each side thereof on which said empty bobbins are mounted to form said full bobbins during a spinning operation, and having a longitudinal carrier carrying a series of movable trays thereon and disposed in front of said row of spindles, each said tray having a peg on the top thereof on which said full or empty bobbin is held and an engaging recess underside thereof, and said trays being carried on said carrier so that a distance corresponding to a spindle pitch or half a spindle pitch is maintained between every adjacent two pegs, said full and empty bobbins mounted on said trays being transferred forward together with said trays by a repeated back-and-forth reciprocation at a predetermined stroke of said carrier in such a manner that said trays are moved forward by forward displacement of said carrier and a checking mechanism for maintaining said trays in the forward position during the backward displacement of said carrier, characterized in that said checking mechanism comprises at least one stationary hooking bar extending beneath and along said carrier and provided with a plurality of hooks shaped thereon and distributed at a predetermined distance corresponding to $N \times p$ from each other, wherein N stands for a natural number satisfying the equation $\Delta A \geqq \Delta D \times N$ (wherein $\Delta D$ stands for a manufacturing tolerance of a diameter of the tray and $\Delta A$ stands for an allowance for the grip distance of the bobbin catcher in the auto-doffer) and p stands for a spindle pitch, spring means for resiliently urging each of said hooking bars upwardly so that each said hook is engageable with said engaging recess of said tray to interrupt the backward displacement of said tray during the backward displacement of said carrier and to allow said tray to advance together with said carrier during the forward displacement of the carrier.

2. A system as defined in claim 1, in which said hooks are formed on said hooking bar at a distance from each other corresponding to the spindle pitch.

3. A system as defined in claim 1, in which a leaf spring resiliently supports said hooking bar at opposite ends thereof.

* * * * *